United States Patent [19]

Van Ackeren et al.

[11] 4,067,778

[45] Jan. 10, 1978

[54] APPARATUS AND METHOD FOR SEALING COKE OVEN DOORS

[75] Inventors: Joseph Van Ackeren; Linwood G. Tucker, both of Pittsburgh, Pa.

[73] Assignee: Koppers Company, Inc., Pittsburgh, Pa.

[21] Appl. No.: 748,513

[22] Filed: Dec. 8, 1976

Related U.S. Application Data

[60] Division of Ser. No. 514,304, Oct. 15, 1974, Pat. No. 4,016,046, which is a continuation-in-part of Ser. No. 397,708, Sept. 17, 1973, abandoned.

[51] Int. Cl.[2] ..... C10B 25/06

[52] U.S. Cl. ..... 202/248; 202/269

[58] Field of Search ..... 110/173 R, 173 A; 202/248, 269, 242, 247, 263; 122/498; 126/190; 49/184

[56] References Cited

U.S. PATENT DOCUMENTS

| | | | |
|---|---|---|---|
| 3,172,825 | 3/1965 | Maloney | 202/248 |
| 3,926,740 | 12/1975 | Krikav | 202/254 |
| 3,957,591 | 5/1976 | Riecker | 202/263 |

FOREIGN PATENT DOCUMENTS

| | | | |
|---|---|---|---|
| 1,156,762 | 11/1961 | Germany | 202/248 |

*Primary Examiner*—Hiram H. Bernstein
*Attorney, Agent, or Firm*—R. Lawrence Sahr; Oscar B. Brumback

[57] ABSTRACT

A coke oven door has a primary seal that includes a first metal knife edge in contact with a door jamb first sealing surface, and a secondary seal that includes a second metal knife edge in contact with a door jamb second sealing surface. The plenum or space between the sealing knife edges is maintained at super atmospheric pressure by flowing coke oven gas into the plenum. In a modification of the invention, the secondary seal includes a metal strip in contact with an elastic material; the plenum between the sealing surfaces being also pressurized above atmospheric pressure and purged of coke oven gas.

4 Claims, 4 Drawing Figures

FIG. 4
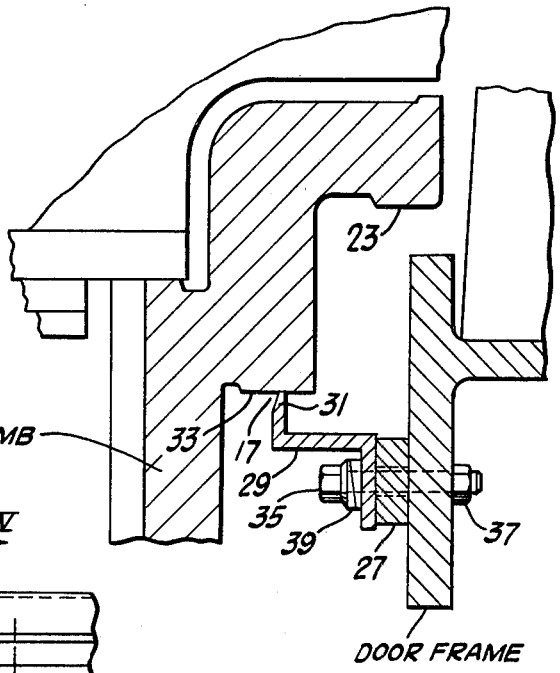
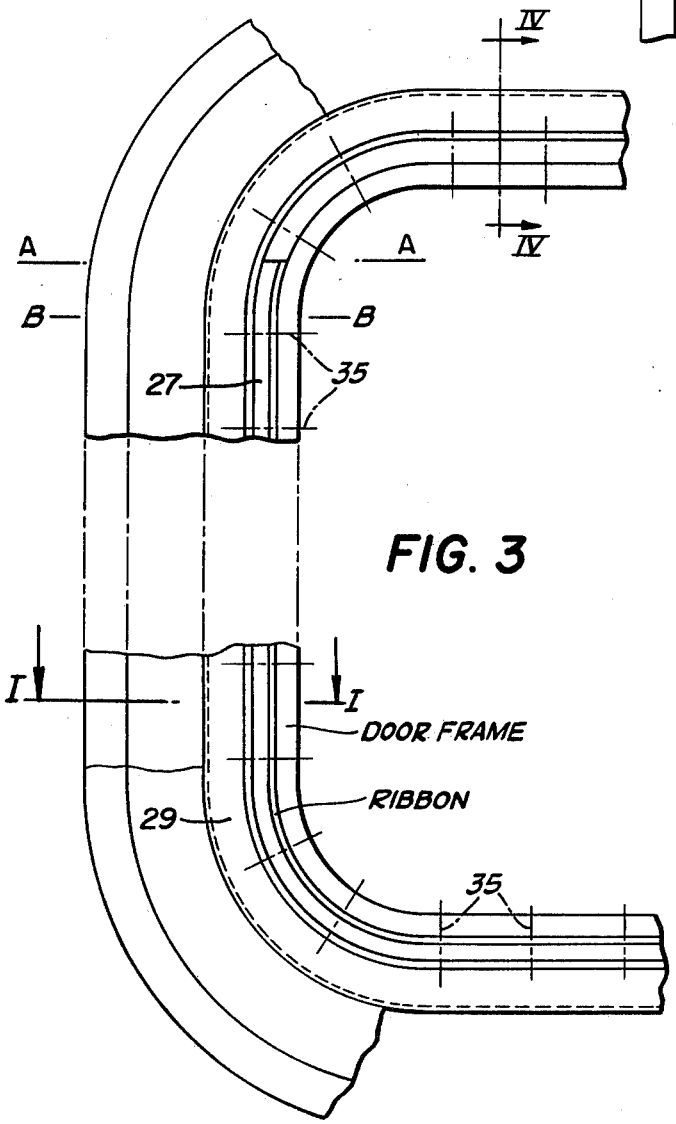
FIG. 3

APPARATUS AND METHOD FOR SEALING COKE OVEN DOORS

CROSS REFERENCE TO RELATED APPLICATION

This is a division, of application Ser. No. 514,304, filed Oct. 15, 1974 now U.S. Pat. No. 4,016,046 which application is a continuation-in-part of application Ser. No. 397,708 filed Sept. 17, 1973, and now abandoned.

BRIEF SUMMARY OF THE INVENTION

Seals of a coke oven door acting on a door jamb create a plenum that is pressurized by introducing coke oven gas thereinto. The primary seal is a metal band contacting the door jamb and the secondary seal is either a metal to metal engagement or a metal to silicone rubber engagement.

During the coking coke oven gas at slightly higher than ambient pressure is introduced into the plenum. When it is necessary to remove the door, the coke oven gas is removed by evacuation means, and ambient air replaces the coke oven gas.

In one embodiment of the invention the primary seal does not exist around the entire periphery of the door. In another embodiment of the invention the primary and secondary seals extend around the entire periphery of the door.

For a further understanding of the invention and for features and advantages thereof, reference may be made to the following description and the drawing which illustrates a preferred embodiment of equipment in accordance with the invention.

BRIEF DESCRIPTION OF THE DRAWINGS

In the drawings:

FIG. 3 is a schematic front elevational view of a portion of a coke oven door carrying one embodiment of the present invention; and FIG. 4 is a view along line IV—IV of FIG. 3.

DETAILED DESCRIPTION

Figure 1:
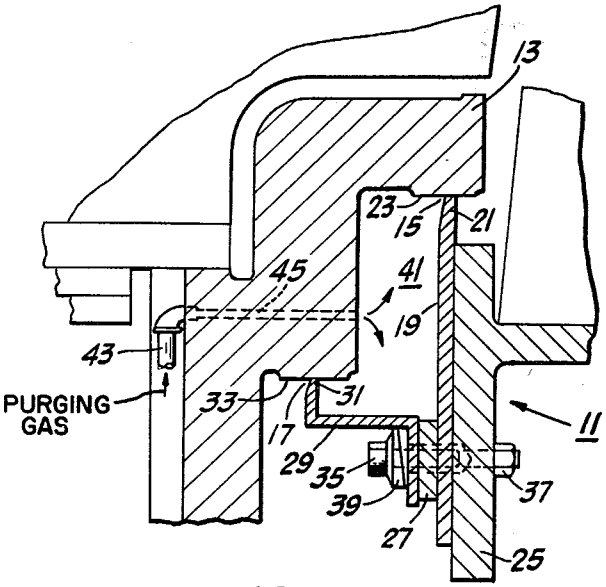
FIG. 1 is a schematic view along line I—I of FIG. 3, showing a portion of a coke oven door and door jamb, that includes seals in accordance with the invention.

Referring to FIG. 1, a portion of the coke oven door 11 and door jamb 13 are shown in juxtaposition with a primary door seal 15 and a secondary seal 17 in operative position.

The primary door seal 15 includes an elongate ribbon 19, having a knife edge 21 that is of conventional form that contacts a primary sealing surface 23 on the door jamb 13 as shown.

The ribbon 19 is secured to the frame portion 25 of the coke oven door 11 by means of an elongate bar 27 which is doweled to the door frame portion 25 of the coke oven door 11. The elongate bar also coacts with a Z-form bar 29 having at one end a knife edge 31 that coacts with a secondary sealing surface 33 of the door jamb 13. A plurality of bolts 35, nuts 37, and wedge-type clamps 39, as shown in FIG. 1, hold the ribbon 19 and Z-form bar 29 in position horizontally. The ribbon 19 and Z-form bar 29 have elongate holes so that each bar may be adjusted vertically, as viewed in FIG. 1.

The ribbon 19, bar 27 and Z-form bar 29 extend along the two vertical sides and along the bottom edge of the door frame 25, but only the bar 27 and the Z-form bar extend along the top edge of the door frame. the ribbon 19 is not present at the top of the door frame 25. The ribbon 19 terminates on both sides of the door at elevation A—A of FIG. 3. Level B—B represents also the approximate level of the coal being coked in the oven chamber. A section through the door sealing mechanism at the top of the door 11 is shown in FIG. 4 wherein it will be seen that only the secondary seal 17 is present.

It will be noted that when the door 11 is in place and when both knife edges 21, 31 are in contact with their respective sealing surfaces 23, 33, there exists a plenum 41 that is open to the oven chamber above the coal line A—A in the chamber. A conduit 43 connects with a passageway 45 in the door jamb 13 so that a purging gas, such as clean coke oven gas, flowing in the conduit 43 and passageway 45, fills the plenum 41. Since the plenum is open at the top, the purging gas flows into the oven above the coal line. The gas pressure in the plenum 41 in maintained at a relatively low pressure, such as about 10 mm of water column above atmospheric pressure.

The primary seal 15 prevents coal from blocking the plenum 41, and if the plenum can be kept open, the pressure therein, acting on the secondary seal 17, can be kept low, at the value indicated previously, even when the oven is being charged initially.

The purging gas is optional. It is not intended that the purging gas in the plenum will prevent raw coke oven gas from entering the plenum, flowing by the primary seal 15. The gas pressure in the plenum 41 is purposely low since the plenum is open at the top. The purging gas acts as a sweeping medium to minimize the concentration of dirty gas in the plenum and to reduce the tar condensation. Wherefore, the coke oven door and door jamb can be more easily cleaned.

Figure 2:
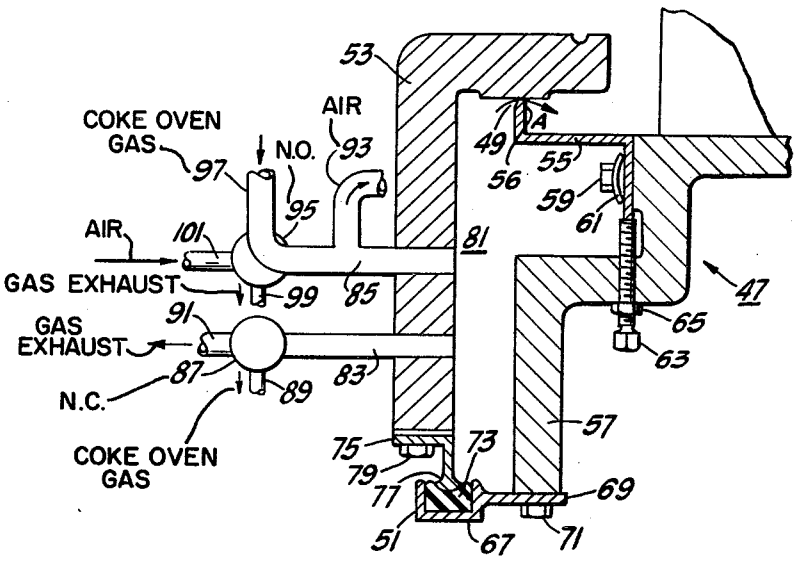
FIG. 2 is a schematic view like that of FIG. 3, but showing a modification of the seals thereof.

FIG. 2 shows a portion of a coke oven door 47 to which are attached a primary seal 49 and a secondary seal 51 with a door jamb 53.

The primary seal 49 includes a Z-form bar 55 having a conventional knife edge 56 that is secured to the door frame portion 57 of the door 47 by a cap screw 59 and Belleville type spring 61, as shown in FIG. 2. The Z-form bar 55 has elongate holes through which the cap screws pass so that the Z-form bar can be adjusted vertically, as viewed in FIG. 2. Adjustment of the Z-form bar 55 is made by turning a bolt 63 extending through the door frame portion 57. A sealing type lock nut 65 is threaded onto the bolt 63 to seal the threaded opening through the door frame portion 57 and to keep and maintain the bolt 63 in a desired position.

The door frame portion 57 is provided with a channel member 67 having an arm extension 69 which is connected to the frame portion 57 by a plurality of cap screws 71 or the like. The channel member 67 is filled with a suitable resilient material 73, such as silicone rubber, or the like.

In juxtaposition to the channel 67 and to the resilient material 73, there is attached to the door jamb 53 an angle-shaped member 75 that is fitted with a shoe 77 that engages the resilient material 73 when the door 47 is installed on the oven battery. The angle-shaped member 75 is secured to the door jamb 53 by means of a plurality of cap screws 79, or the like.

It will be seen from FIG. 2, that, whenever the door 47 is installed on the oven battery, the primary and secondary seals 49, 51 respectively create a plenum 81;

the seals 49, 51 in this instance, however, being complete around the enitre periphery of the door 47.

In FIG. 2 there are shown two conduits 83, 85 passing through the door frame 53. The conduit 83 is located at the top edge, of the door 47, preferably on the top centerline, and the conuduit 85 is located near the bottom edge of the door 47.

The upper conduit 83 includes a vent valve 87 near the top of the door that, when actuated in any suitable manner, purges the plenum 81 of any gas-air mixture that may be therein and that relieves the plenum of positive pressure, so that the door 47 can be safely removed.

The vent valve 87 is connected to two conduits 89, 91 which carry any such gases away from the plenum 81 is described hereinafter.

The conduit 85 is fitted with a branch line 93 that is in communication with the plenum 81 on the other side of the door 47, opposite the conduit 85. Whereby, the flow of gases into and from the plenum 81 through the conduit 85 also takes place through conduit 93.

Also, the conduit 85 is fitted with a three-way valve 95 that is connected to three conduits, 97, 99 and 101, that carry gases into and away from the three-way valve 95, as described hereinafter.

During the coking operations, the primary 15 and the secondary 17 seals around the door 11 effectively prevent leakage of gases to the atmosphere. Coke oven gas flows in the conduit 43 and passageway 45 into the plenum 41. As mentioned previously, such coke oven gas flow into the plenum is optional, but when it is used it does maintain the plenum at a slight pressure, about 10 mm of water column above atmospheric pressure. The coke oven gas entering the plenum flows into the oven chamber since the primary seal 15 does not exist across the top of the door. The flow of coke oven gas in the conduit 43 is shut off of course, when it is necessary to remove the coke oven door before pushing commences.

Considering FIG. 2, in which case both the primary seal 49 and the secondary seal 51 are complete around the entire periphery of the coke oven door, during coking, raw coke oven gas flows in conduits 97, 85, 93 into the plenum 81; the three-way valve 95 being normally open and the valve 87 being normally closed. Coke oven gas in the plenum 81 creates a pressure of about 10 mm of water column above atmospheric pressure that causes coke oven gas, if any, to flow into the coke oven chamber in the direction of arrow A.

When coking in the chamber is completed, and it is necessary to remove the doors on the chamber, the valve 87 is opened so that the coke oven gas in the plenum 81 flows in conduit 89 into the gas collecting main of the battery. At the same time, valve 95 is positioned so that coke oven gas flowing in conduit 97 is stopped and so that air flowing in conduit 101 flows into the plenum 81. After a few minutes time has elapsed, when nearly all of the coke oven gas has been removed from the plenum, the valves 87 and 95 are positioned so that whatever gases remain in the plenum flow in conduits 91 and 99 such conduits being in communication with a steam ejector or the like device.

Thereafter, the door can be removed without the hazard that any coke oven gas in the plenum might flare up and burn. It is to be noted that the door 47 of FIG. 2 is not removed in the same manner, which is conventional, as the door 11. Instead, the door 47 is moved away from the face of the oven on a horizontal level, without first lifting the door in the conventional manner. After the pad has become disengaged from the elastic seal material, then can the door be lifted as necessary. When the door is replaced, it is first moved toward the oven in a horizontal direction, with no vertical movement unitl the pad and seal engage.

After the door has been replaced, the plenum 81 is purged with air flowing thereinto through valve 95 and conduits 101, 85 and 93. The air flows out of the plenum through valve 87 and conduit 91 to atmosphere. Thereafter, valve 87 is closed and valve 95 is so positioned that coke oven gas under slight pressure, as mentioned above, flows in conduits 97, 85, 93 into the plenum. Whereupon, coking commences and proceeds in a normal manner with the plenum under a slight superatmospheric pressure of coke oven gas.

From the foregoing description of one embodiment and a modification of the invention, those skilled in the art should recognize many important features and advantages of it, among which the following are particularly significant:

That the double seals, primary and secondary, insure double protection against leakage of gas to the atmosphere;

That the secondary resilient material seal is effective in preventing leakage of coke oven gas to the atmosphere in cases where the primary metal seal leaks; and That the purge gas system creates a flow of gas toward the into the coke oven chamber, thereby carrying with it any particulate matter that might collect in the plenum.

Although the invention has been described herein with a certain degree of particularity it is understood tht the present disclosure has been made only as an example and that the scope of the invention is defined by what is hereinafter claimed.

What is claimed is:

1. In a coke oven battery having a door, and a door jamb, and a door frame at one end of a coke oven chamber therein, the improvement comprising:

a. a plenum formed by said door jamb and primary sealing means extending around the periphery of said door adapted to coact with a sealing surface on said door jamb, and with b. secondary resilient sealing means extending around the periphery of said door;

c. means on said door jamb that sealingly coacts with said secondary resilient sealing means when said door is installed in place on said coke oven battery; and d. means for pressurizing said plenum.

2. The invention of claim 1 wherein:

a. said plenum comprises two vertical side spaces communicating with a top and a bottom space;

b. said means for pressurizing said plenum includes a first conduit carrying a first fluid under pressure in communication with said bottom space and a second conduit carrying a second fluid under pressure in communication with said bottom space; vertical and including c. means for venting said plenum.

3. The invention of claim 1 wherein:

a. said primary sealing means includes a metal member on said door in contact with a metal surface of said door jamb; and b. said secondary resilient sealing means is silicone rubber.

4. The invention of claim 2 wherein:

a. said means for venting said plenum includes a first valve means communicating with said top space;

b. a third conduit communicating with said valve;

c. a second valve means communicating with said bottom space with which said first conduit and said second conduit communicate, said second valve means being the means by which said first conduit and said second conduit communicate with said bottom space;

d. a first exhaust conduit communicating with said second valve means;

e. a second exhaust conduit communicating with said first valve means;

f. first directing means operating said second valve means which directs sequentially said first fluid to flow through said first conduit into said bottom space, then said second fluid to flow through said second conduit into said bottom space, then said second fluid in said bottom space to flow through said second exhaust conduit but which prevents flow through more than one conduit at a given time; and g. second directing means operating said first valve means which directs that said third conduit and said first exhaust conduit are closed off from said top space when said first fluid is flowing through said first conduit into said bottom space, and which further directs that, when said second fluid is flowing through said second conduit into said bottom space, said first fluid is flowing from said bottom space to said top space and from there out through said third conduit, and which further directs that, when said second fluid on said bottom space is flowing through said second exhaust conduit, said second fluid is concurrently flowing from said bottom space to said top space and out through said first exhaust conduit.

* * * * *